US009362653B2

(12) United States Patent
Tanaka et al.

(10) Patent No.: US 9,362,653 B2
(45) Date of Patent: Jun. 7, 2016

(54) CONNECTOR

(75) Inventors: Masahiro Tanaka, Shizuoka (JP); Hajime Kato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 14 days.

(21) Appl. No.: 14/128,607

(22) PCT Filed: Jun. 20, 2012

(86) PCT No.: PCT/JP2012/065686
§ 371 (c)(1),
(2), (4) Date: Dec. 21, 2013

(87) PCT Pub. No.: WO2012/176786
PCT Pub. Date: Dec. 27, 2012

(65) Prior Publication Data

US 2014/0127920 A1 May 8, 2014

(30) Foreign Application Priority Data

Jun. 21, 2011 (JP) ..... 2011-137136

(51) Int. Cl.
*H01R 13/447* (2006.01)
*H01R 13/713* (2006.01)

(52) U.S. Cl.
CPC ..... *H01R 13/447* (2013.01); *H01R 13/713* (2013.01)

(58) Field of Classification Search
CPC .. H01R 13/512; H01R 13/207; H01R 13/447; H01R 13/5219; H01R 13/5221; H01R 13/6215
USPC ..... 439/93, 133, 892, 559, 364, 135, 277, 439/489
See application file for complete search history.

(56) References Cited

U.S. PATENT DOCUMENTS 5,336,116 A * 8/1994 Boteler ..... 439/690
6,056,592 A 5/2000 Hashizawa et al.

(Continued)

FOREIGN PATENT DOCUMENTS

DE 19848554 A1 5/1999
JP 11-126661 A 5/1999

(Continued)

OTHER PUBLICATIONS

International Search Report and Written Opinion of the International Search Report for PCT/JP2012/065686 dated Sep. 4, 2012.

(Continued)

*Primary Examiner* — James Harvey
*Assistant Examiner* — Oscar C Jimenez
(74) *Attorney, Agent, or Firm* — Kenealy Vaidya LLP

(57) ABSTRACT

An object of the present invention is to provide a connector able to prevent a first interlock connector from making contact with a bolt, a terminal fitting, or the like, and able to position a cover for covering a bolting chamber. The connector includes: the terminal receiving portion provided with the terminal fittings to be connected to the electrodes of the connector attachment portion; the cover member for covering the terminal receiving portion; the first interlock connector projecting from the cover member; and the second interlock connector provided on the terminal receiving portion and configured to be fitted to the first interlock connector. When the cover member covers the terminal receiving portion, the first interlock connector and the second interlock connector are fitted to each other, thereby the connector detects that the cover member covers the terminal receiving portion and allows the terminal fittings to be energized with the electrodes of the connector attachment portion. The terminal receiving portion is provided with: the bolting chambers in which the terminal fittings and the electrodes are fastened with bolts; the insertion hole into which the first interlock connector is inserted; and the partition wall separating the bolting chambers from the insertion hole. Further, the second interlock connector is provided at a position corresponding to the insertion hole.

2 Claims, 6 Drawing Sheets

(56) References Cited

U.S. PATENT DOCUMENTS

| | | | | |
|---|---|---|---|---|
| 7,306,475 | B2 * | 12/2007 | Tsuruta | 439/364 |
| 2011/0100704 | A1 | 5/2011 | Iida et al. | |
| 2013/0228431 | A1 * | 9/2013 | Kalayjian et al. | 200/48 R |
| 2014/0113489 | A1 * | 4/2014 | Tanaka et al. | 439/607.53 |

FOREIGN PATENT DOCUMENTS

| | | | |
|---|---|---|---|
| JP | 2006-92776 | A | 4/2006 |
| JP | 2008-218094 | A | 9/2008 |
| JP | 2011-96501 | A | 5/2011 |
| JP | 2011-100551 | A | 5/2011 |
| WO | 2011/055768 | A1 | 5/2011 |
| WO | WO 2011055768 | A1 * | 5/2011 |

OTHER PUBLICATIONS

Supplementary European Search Report for European Patent App. No. 12803001.2 (Jan. 13, 2015).

* cited by examiner

CONNECTOR

TECHNICAL FIELD

The present invention relates to a connector able to prevent a first interlock connector from making contact with a bolt, a terminal fitting, or the like, and able to position a cover for covering a bolting chamber.

BACKGROUND ART

A three-phase AC motor as a power source, a battery as an electric source, and an inverter for converting DC power source into three-phase AC power source are mounted on an electric vehicle or a hybrid electric vehicle. The three-phase AC motor and the battery are connected to each other via the inverter. The three-phase AC motor and the inverter are electrically connected to each other via an electric wire. The inverter and the battery are electrically connected to each other via the electric wire.

The electric wire for supplying three-phase AC power source to the three-phase AC motor is connected to a connector attached to a connector attachment of the inverter (for example, see PTL 1). The connector shown in PTL 1 includes: a terminal; a bolting chamber where an electrode of a connector attachment portion of the inverter and the terminal are fastened with a bolt; a cover for covering the bolting chamber; an interlock male terminal vertically extended from the cover; and an interlock female terminal extended vertically from the bolting chamber.

Further, in the connector shown in PTL 1, because high voltage is applied to the three-phase AC motor and the inverter, when the cover covers the bolting chamber, the interlock male and female terminals are connected to each other to permit conduction between the electrode and the terminal fitting.

However, in the connector shown in PTL 1, when the terminal fitting and the electrode are fastened with a bolt, there is a fear that a bolt-fastening tool may collide with the interlock female terminal and may damage the interlock female terminal.

In view of such a problem, the applicant of the present invention proposed a connector 101 shown in FIG. 7 (JP, Patent Application No. 2009-252686). The connector 101 includes: a terminal fitting 121; a bolting chamber 111 where an electrode 144 of a connector attachment portion 102 and the terminal fitting 121 are fastened with a bolt; a cover for covering the bolting chamber 111; a first interlock terminal 128 vertically extended from the cover 106; a second interlock terminal 139 provided in the bolting chamber 111, lower than the terminal fitting 121, and in between the terminal fittings 121.

CITATION LIST

Patent Literature

[PTL 1]
JP, A, H11-126661

SUMMARY OF INVENTION

Technical Problem

However, in the connector 101 proposed by the applicant of the present invention, because the second interlock terminal 139 is provided in the bolting chamber 111, lower than the terminal fitting 121, and in between the terminal fittings 121, there is a problem when the cover 106 covers the bolting chamber 111, the first interlock terminal 128 vertically extended from the cover 106 may collide with or make contact with the bolt 145 and the terminal fitting 121.

Further, in the connector 101, because the second interlock terminal 139 is provided lower than the terminal fitting 121, when the cover 106 covers the bolting chamber 111, the cover cannot be positioned until the first interlock terminal 128 and the second interlock terminal 139 are fitted to each other. Therefore, there is a problem when the cover 106 is pushed to the bolting chamber 111 while the cover is displaced, a packing member of the cover 106 may be gouged by an opening edge of the bolting chamber 111.

An object of the present invention is to solve the above problems. Namely, an object of the present invention is to provide a connector able to prevent a first interlock connector from making contact with a bolt, a terminal fitting, or the like, and able to position a cover for covering a bolting chamber.

Solution to Problem

For solving the above problems and attaining the object, according to a first aspect of the present invention, there is provided a connector including:

a terminal receiving portion provided with a terminal fitting to be connected to an electrode of a connector attachment portion;

a cover member for covering the terminal receiving portion:

a first interlock connector projecting from the cover member; and a second interlock connector provided on the terminal receiving portion and configured to be fitted to the first interlock connector, wherein when the cover member covers the terminal receiving portion, the connector detects that the first and second interlock connectors are fitted to each other, and the cover member covers the terminal receiving portion to permit conduction between the electrode of the connector attachment portion and the terminal fitting, wherein the terminal receiving portion is provided with a bolting chamber in which the terminal fitting and the electrode are fastened with a bolt, an insertion hole into which the first interlock connector is inserted, and a partition wall for separating the bolting chamber from the insertion hole, and wherein the second interlock connector is provided at a position corresponding to the insertion hole.

According to a second aspect of the present invention, there is provided the connector as described in the first aspect, wherein the partition wall is a connection wall formed by respectively opening a position corresponding to the insertion hole and a position corresponding to the bolting chamber.

Advantageous Effects of Invention

According to the invention described in the first aspect, in the connector, because the partition wall partitions the bolting chamber and the insertion hole, the first interlock connector can be prevented from making contact with or colliding with the terminal fitting in the bolting chamber, a bolt for fastening the terminal fitting and the electrode, or the like.

Further, because the second interlock connector is provided in the insertion hole for inserting the first interlock connector, the cover member is positioned as the first interlock connector is inserted into the insertion hole.

Therefore, the cover member is prevented from being assembled to the bolting chamber while the cover member is displaced, and the packing of the cover member is prevented from being gouged by an opening edge of the bolting chamber.

According to the invention described in the second aspect, in the connector, because the partition wall is a connection wall formed by opening a position corresponding to the insertion hole and a position corresponding to the bolting chamber, the terminal receiving portion is connected to the connection wall. Therefore, the terminal receiving portion is prevented from being deformed by shrinkage upon molding.

DESCRIPTION OF EMBODIMENTS

Figure 1:
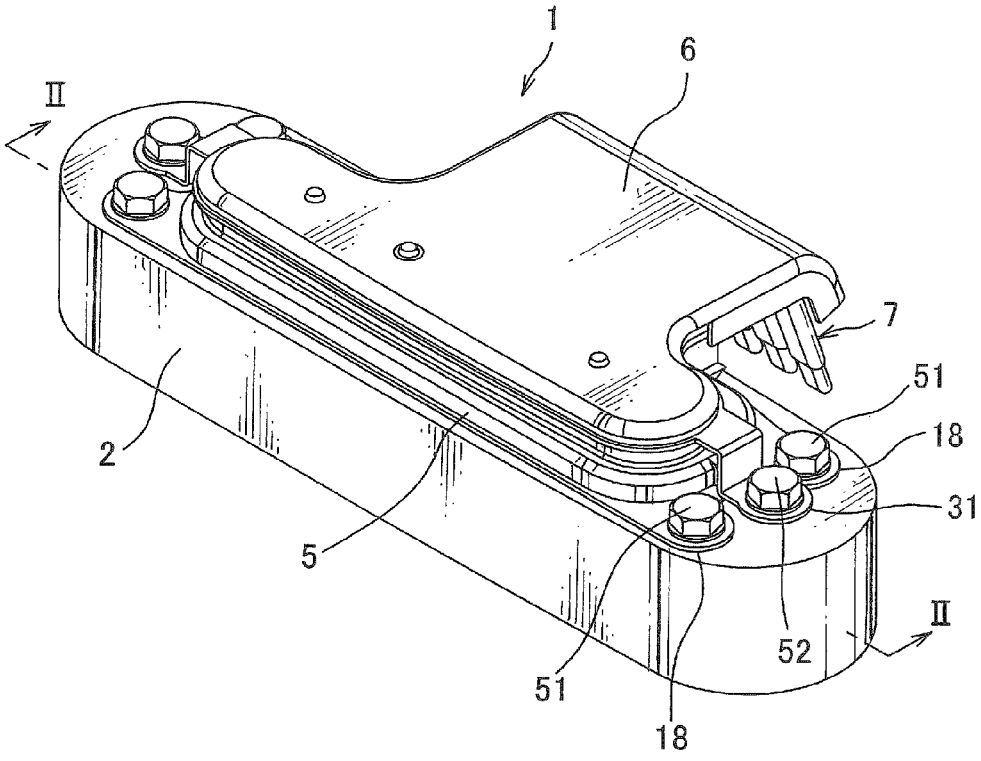
FIG. 1 is a perspective view showing a connector according to an embodiment of the present invention.

Hereinafter, an embodiment of the present invention will be explained with reference to FIGS. 1 to 5. As shown in FIG. 1, a connector 1 according to the embodiment of the present invention includes: a connector housing 5 fastened and fixed to a connector attachment portion 2 of an inverter with a bolt 51; a water-stop member 19 (shown in FIG. 4); and a cover member 6.

Figure 3:
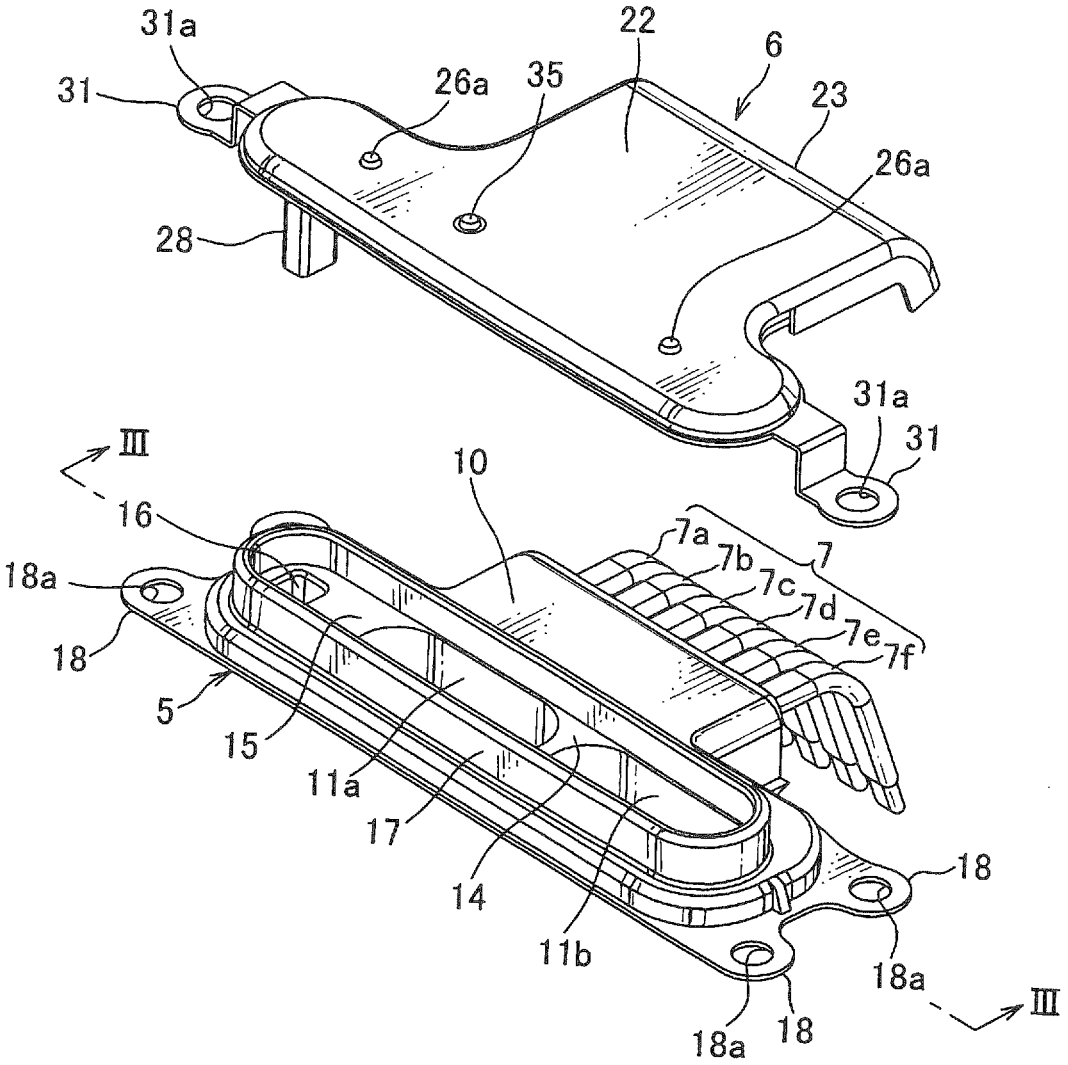
FIG. 3 is a perspective view showing a connector housing and a cover.

As shown in FIG. 3, the connector housing 5 includes: a guide-out portion 10 from which electric wires 7*a* to 7*f* are guided out; a plurality of attachment pieces 18 (four in an example shown in FIG. 3) each having an insertion hole 18*a* into which the bolt 51 is inserted; a terminal receiving portion 17 receiving a terminal fitting 12 to one end of which an electric wire 7 is connected, and to the other end of which electrodes 44*a* to 44*f* of the connector attachment portion 2 are connected. The connector housing 5 is made of conductive metal such as copper, copper alloy, aluminum, or aluminum alloy.

The guide-out portion 10 is formed in a tubular shape. Wire connecting portions of terminal fittings 12*a* to 12*f* are arranged in the guide-out portion 10. A plurality of electric wires 7*a* to 7*f* (six in an example shown in FIG. 3) is guided out from the guide-out portion 10. Each of the electric wires 7*a* to 7*f* includes: a conductive core wire; and an insulating cover. The core wire is formed by twisting lead wires made of conductive metal such as copper, copper alloy, aluminum, or aluminum alloy. The cover covers the core wire, and made of insulating synthetic resin such as polyvinyl chloride resin. Incidentally, the core wire may be composed of a single wire.

The attachment pieces 18 are respectively provided on one end and the other end in a longitudinal direction of the connector housing 5. A plurality of attachment pieces 18 (two in an example shown in FIG. 3) are respectively provided on both ends in the longitudinal direction of the connector housing 5. Each of the attachment pieces 18 is formed in a thin plate shape. The insertion hole 18*a* for inserting the bolt 51 is provided on each of the attachment pieces 18.

Figure 4:
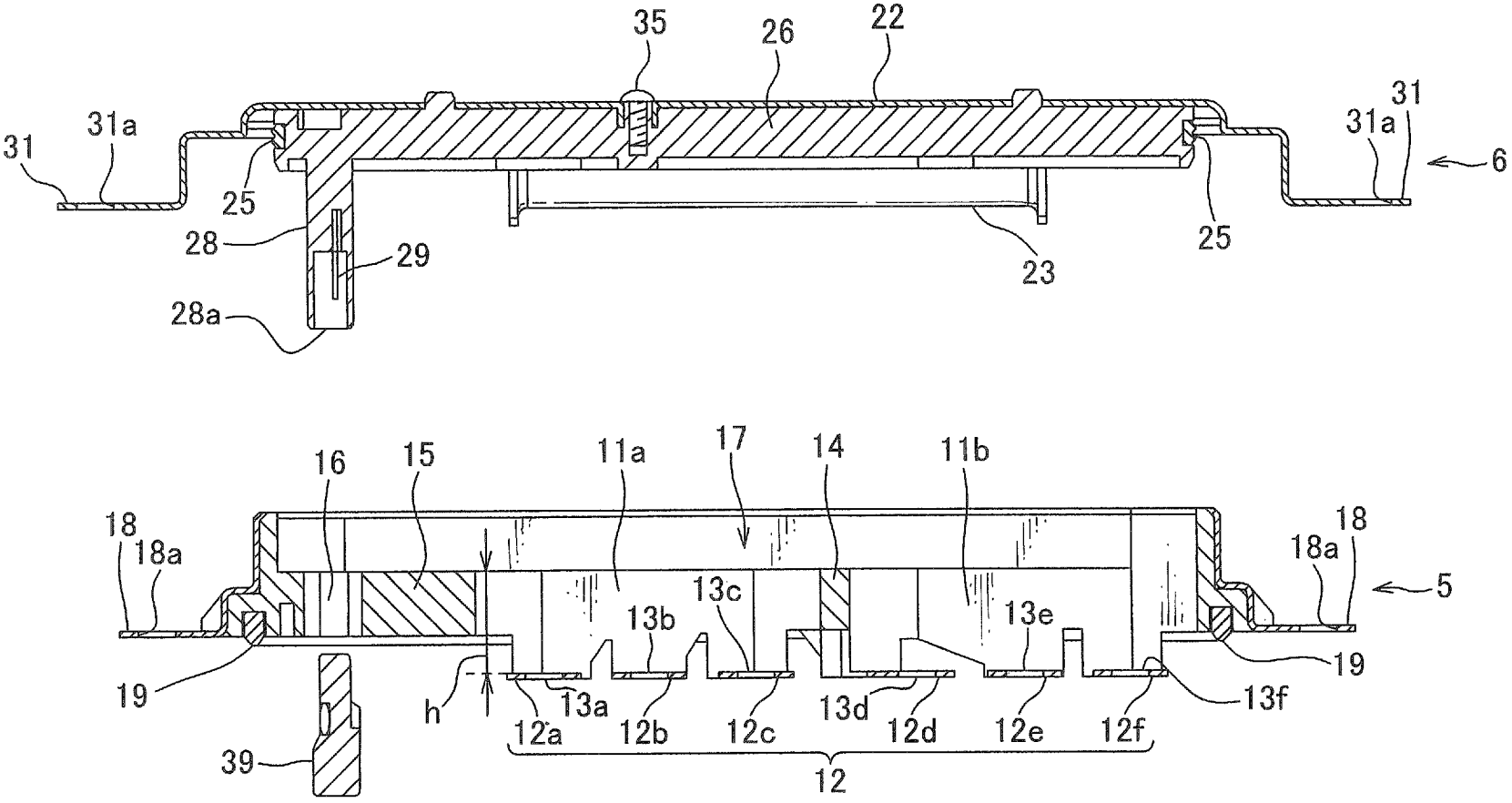
FIG. 4 is a sectional view taken on line III-III of the connector housing and the cover shown in FIG. 3.
Figure 5:
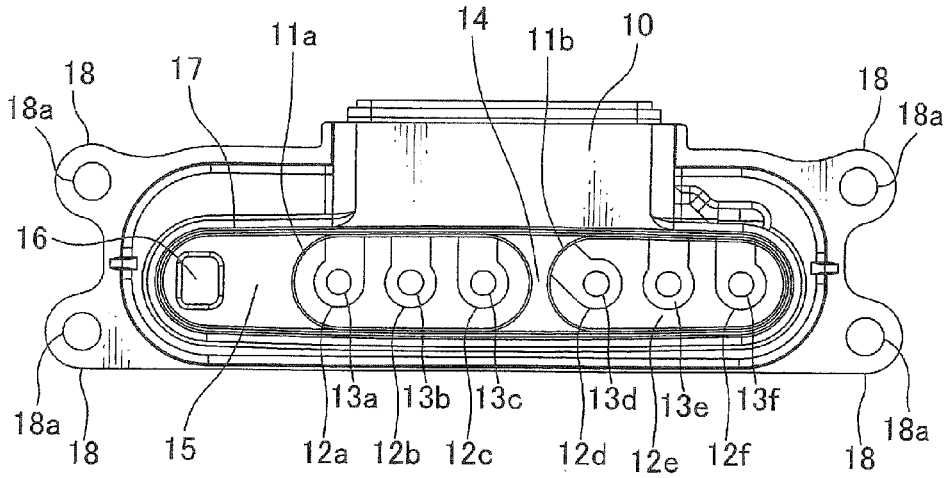
FIG. 5 is a plan view showing a connector housing from which the cover is removed.

As shown in FIGS. 3 and 5, an opening of the terminal receiving portion 17 is formed in an oval shape, and both ends thereof are formed in an arc shape. The terminal receiving portion 17 is provided with bolting chambers 11*a*, 11*b* in which the other ends of the terminal fittings 12*a* to 12*f* are fastened to the electrodes 44*a* to 44*f* with bolts, an insertion hole 16, and a partition wall 15 for separating the bolting chambers 11*a*, 11*b* from the insertion hole 16. A packing 25 (shown in FIGS. 2 and 4) of a later-described cover member 6 slidingly abuts on an inner periphery of the opening of the terminal receiving portion 17.

The bolting chambers 11*a*, 11*b* are opened in an oval shape, and both ends thereof are opened in an arcuate shape. The bolting chambers 11*a*, 11*b* are formed in an concave hole shape. The bolting chambers 11*a*, 11*b* are so deep that heads of bolts 45*a* to 45*f* fastening the terminal fittings 12*a* to 12*f* are lower than a wall portion 14. The bolting chambers 11*a*, 11*b* are adjacent to each other via the wall portion 14. The bolting chamber 11*a* is provided with the terminal fittings 12*a* to 12*c*, and attachment holes 13*a* to 13*c* for the bolts 45*a* to 45*c* are arranged at equal intervals in the bolting chamber 11*a*. The bolting chamber 11*b* is provided with the terminal fittings 12*d* to 12*f*, and attachment holes 13*d* to 13*f* are arranged at equal intervals in the bolting chamber 11*b*.

The terminal fittings 12*a* to 12*f* are formed by pressing and folding a metal plate made of conductive metal such as copper, copper alloy, aluminum, or aluminum alloy. One ends of the terminal fittings 12*a* to 12*f* are provided with swage pieces for swaging the electric wires 7*a* to 7*f*, and the other ends of the terminal fittings 12*a* to 12*f* are provided with the attachment holes 13*a* to 13*f* into which the bolts 45*a* to 45*f* are respectively inserted and fastening the electrodes 44*a* to 44*f*.

Figure 2:
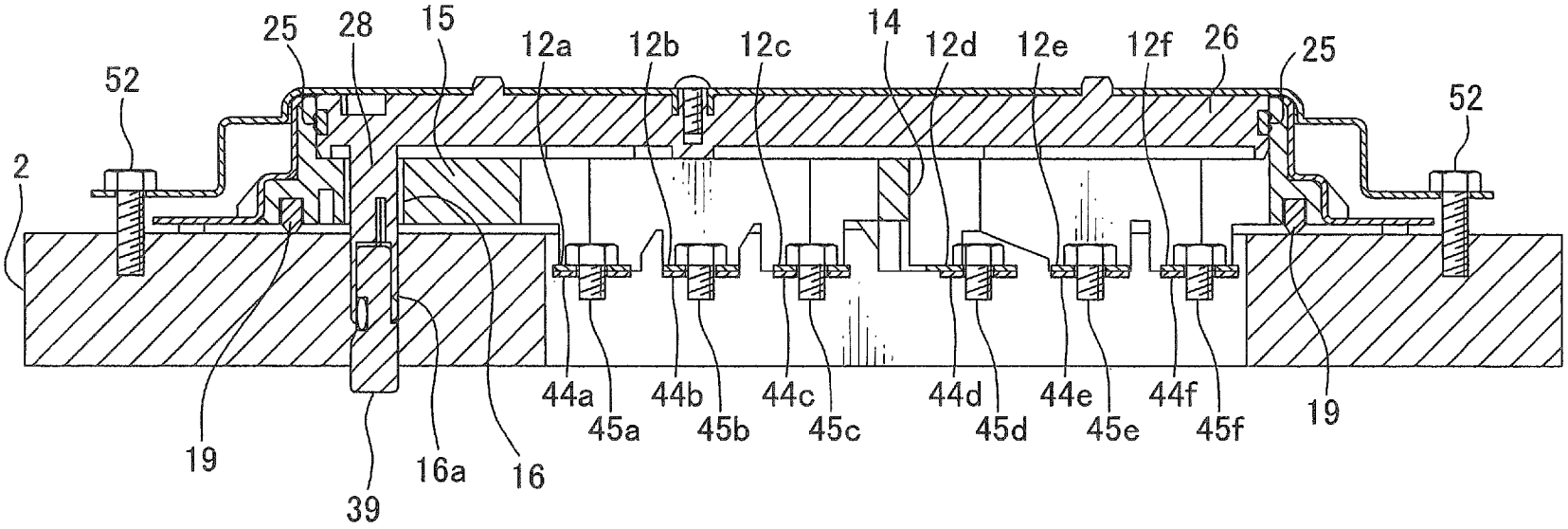
FIG. 2 is a sectional view taken on line II-II of the connector shown in FIG. 1.

As shown in FIGS. 2 and 5, the insertion hole 16 is provided on one end in a longitudinal direction of the terminal receiving portion 17. The insertion hole 16 forms a series of insertion holes 16, 16*a* together with a second insertion hole 16*a* provided on the connector attachment portion 2 and continued to the insertion hole 16. The series of the insertion holes 16, 16*a* are formed in a rectangular shape, and slightly larger than an outer diameter of a first interlock connector 28 of the later-described cover member 6 to allow the first interlock connector 28 to be inserted into the series of the insertion holes 16, 16*a*.

Incidentally, in the embodiment shown by figures, because the first interlock connector 28 is long, the first interlock connector 28 is inserted into the insertion hole 16 at a position where the cover member 6 is sufficiently away from the connector housing 5. Therefore, a second interlock connector 39 is provided on the insertion hole 16*a* of the connector attachment portion 2. Therefore, the second interlock connector 39 may be provided on the insertion hole 16. Namely, it is enough that the second interlock connector 39 is provided on a position corresponding to the insertion hole 16 so that the first interlock connector 28 inserted into the insertion hole 16 can be fitted to the second interlock connector 39.

In the present invention, the phrase that the second interlock connector 39 is provided on a position corresponding to the insertion hole 16 means that the second interlock connector 39 is arranged on an axis of the insertion hole 16.

The second interlock connector 39 is provided in the second insertion hole 16*a*. The second insertion hole 16*a* and the second interlock connector 39 are fitted to each other and fixed to each other.

The second interlock connector 39 is formed in a square pole shape, and provided with an electric contact portion of a second interlock terminal made of conductive metal at a tip end of the second interlock connector 39. The tip end of the second interlock connector 39 is shrunken. The electric contact portion is connected to an energization detection circuit of a switching device to allow the electrodes 44*a* to 44*f* of the connector attachment portion 2 to be energized. The electric contact portion is configured to be short-circuited by a later-described first interlock terminal 29 provided on the first interlock connector 28. When the switching device detects the shot-circuit of the energization detection circuit, the switching device allows the electrodes 44*a* to 44*f* of the connector attachment portion 2 to be energized.

As shown in FIG. 3, the partition wall 15 is provided between the insertion hole 16 and the bolting chamber 11*a*. The partition wall 15 is a connection wall formed by opening a position corresponding to the insertion hole 16 and opening a position corresponding to the bolting chambers 11*a*, 11*b*. Therefore, the connection wall is connected to the terminal receiving portion 17 as a space for attaching the cover member 6 to prevent the terminal receiving portion 17 from being deformed by shrinkage upon molding.

In the present invention, the phrase that the connection wall formed by opening a position corresponding to the insertion hole 16 and opening a position corresponding to the bolting chambers 11*a*, 11*b* means that a portion of the terminal receiving portion 17 which is not opened is made as the connection wall. Therefore, the insertion hole 16 and the bolting chambers 11*a*, 11*b* become a minimum space to keep the strength of the terminal receiving portion 17 and to prevent the terminal receiving portion 17 from being deformed upon molding.

A thickness of the partition wall 15 is formed about twice as a hole diameter of the insertion hole 16. Incidentally, the thickness of the partition wall 15 is for a purpose of sufficiently separating the insertion hole 16 and the bolting chamber 11*a*, and as long as the first interlock connector 28 does not abut on the electrodes 44*a* to 44*c* and the bolts 45*a* to 45*c* when the cover member 6 is attached to the connector housing 5.

As shown in FIGS. 2 and 4, the water-stop member 19 is provided on a lower surface of the connector housing 5, and formed in a ring shape along an outer shape of the terminal receiving portion 17. The water-stop member 19 is made of synthetic rubber having rubber elasticity such as silicon rubber. The water-stop member 19 is attached to a concave groove formed on the lower surface of the connector housing 5.

As shown in FIGS. 3 and 4, the cover member 6 includes: a main body 26; an upper wall plate 22 provided on an upper surface of the main body 26; a packing 25 provided on a sidewall of the main body 26; and the first interlock connector 28 vertically extended from the main body 26.

The main body 26 is formed in a shape able to be slid along an inner periphery of the opening of the terminal receiving portion 17 and inserted into the opening. The main body 26 is made of insulating synthetic resin such as polybutylene terephthalate resin. The main body 26 is provided with a not-shown screw hole and positioning projections 26*a*, 26*a*.

The upper wall plate 22 is formed in a shape able to cover an upper surface of the main body 26, the guide-out portion 10, and the electric wires 7*a* to 7*f* guided out from the guide-out portion 10. The upper wall plate 22 is provided with an eave 23 bent downward for covering the electric wires 7*a* to 7*f*. The upper wall plate 22 is provided with a screw 35 screwed with a screw hole of the main body 26; opening holes into which the positioning projections 26*a*, 26*a* of the main body 26 are inserted; and an attachment piece 31 having an insertion hole 31*a* into which a bolt 52 is inserted. The upper wall plate 22 is made of alloy steel such as stainless steel, and formed by pressing.

The eave 23 is formed by bending along a shape of the electric wires 7*a* to 7*f* guided out from the guide-out portion 10 and bent downward.

The packing 25 is made of synthetic rubber having rubber elasticity such as silicon rubber. The packing 25 is attached to a concave groove formed on a sidewall of the main body 26.

As shown in FIGS. 3 and 4, the first interlock connector 28 is formed in a square pole shape along a shape of the insertion hole 16. The first interlock connector 28 is formed so long as to be fitted to the second interlock connector 39. A hole 28*a* is formed on a tip end of the first interlock connector 28, and the first interlock terminal 29 is provided in the hole 28*a*.

The hole 28*a* is formed along an outer shape of the shrunken tip end of the second interlock connector 39. The first interlock terminal 29 is made of conductive metal, and abuts on the electric contact portion at the tip end of the second interlock terminal of the second interlock connector 39 to short-circuit the electric contact portion.

Next, an installation method of attaching the above connector 1 to the connector attachment portion 2 of the inverter will be explained.

First, as shown in FIG. 3, the connector housing 5 provided with the terminal fittings 12*a* to 12*f* swaging the electric wires 7*a* to 7*f* is attached to the connector attachment portion 2, and the terminal fittings 12*a* to 12*f* and the electrodes 44*a* to 44*f* overlapped with each other are fastened with the bolts 45*a* to 45*f*.

Next, the cover member 6 is pushed toward the terminal receiving portion 17 of the connector housing 5. At this time, the first interlock connector 28 of the cover member 6 is inserted into the insertion hole 16 of the connector housing 5 to position the cover member 6 and the connector housing 5. Further, at this time, because the first interlock connector 28 formed in a square pole shape is inserted into the insertion hole 16 opened in a square shape, positioning accuracy in a planar direction between the cover member 6 and the connector housing 5 is improved.

Next, the first interlock connector 28 is fitted to the second interlock connector 39 to make the first interlock terminal 29 of the first interlock connector 28 contact with the electric contact portion at the tip end of the second interlock terminal of the second interlock connector 39.

Then, the energization detection circuit of the switching device detects that the cover member 6 covers the terminal receiving portion 17 to allow the electrodes 44*a* to 44*f* to be energized, and the three-phase AC power source is supplied to the motor via the electric wires 7*a* to 7*f*.

Figure 6:
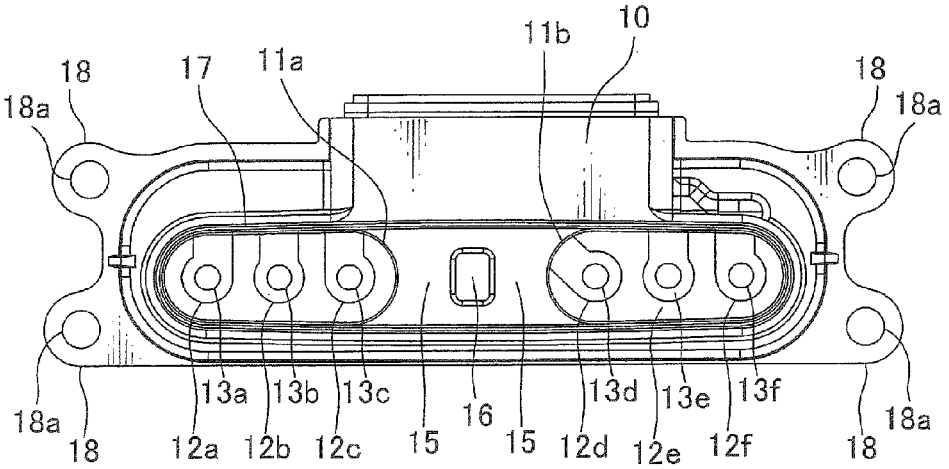
FIG. 6 is a plan view showing a modified embodiment of the connector according to the present invention.
Figure 7:
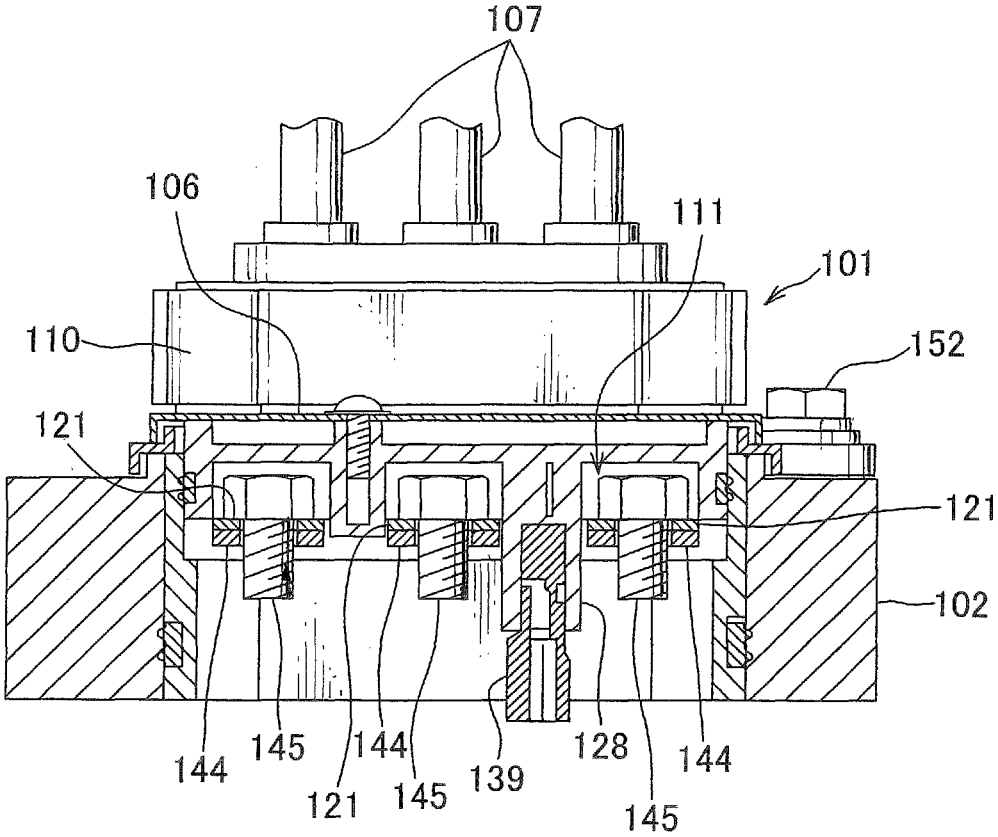
FIG. 7 PRIOR ART
FIG. 7 is an explanatory view for explaining a configuration of a conventional connector.

Incidentally, as a modified embodiment of the connector 1, as shown in FIG. 6, the bolting chamber 11*a* may be provided on one end in a longitudinal direction of the terminal receiving portion 17, the bolting chamber 11*b* may be provided on the other end in the longitudinal direction of the terminal receiving portion 17, the insertion hole 16 having the second interlock connector 39 may be provided in the center of the terminal receiving portion 17, the partition wall 15 may be provided between the insertion hole 16 and the bolting chamber 11*a*, and the partition wall 15 may be provided between the insertion hole 16 and the bolting chamber 11*b*. The first interlock connector 28 is provided in the center of the cover member 6 and provided at a position corresponding to the insertion hole 16.

In the connector 1 configured as such, because the partition walls 15, 15 partition the insertion hole 16 and the bolting chambers 11*a*, 11*b*, the first interlock connector 28 is prevented from making contact with or colliding with the terminal fittings 12*a* to 12*f* in the bolting chambers 11*a*, 11*b* and the bolts 45*a* to 45*f* for fastening the terminal fittings 12*a* to 12*f* and the electrodes 44*a* to 44*f*.

According to this embodiment, the connector 1 includes: the terminal receiving portion 17 provided with the terminal fittings 12*a* to 12*f* to be connected to the electrodes 44*a* to 44*f* of the connector attachment portion 2; the cover member 6 for covering the terminal receiving portion 17; the first interlock connector 28 projected from the cover member 6; and the second interlock connector 39 provided on the terminal receiving portion 17 and configured to be fitted to the first interlock connector 28. When the cover member 6 covers the terminal receiving portion 17, the first interlock connector 28 and the second interlock connector 39 are fitted to each other, thereby the connector 1 detects that the cover member 6 covers the terminal receiving portion 17 and allows the terminal fittings 12*a* to 12*f* to be energized with the electrodes 44*a* to 44*f* of the connector attachment portion 2. The terminal receiving portion 17 is provided with: the bolting chambers 11*a*, 11*b* in which the terminal fittings 12*a* to 12*f* and the electrodes 44*a* to 44*f* are fastened with bolts; the insertion hole 16 into which the first interlock connector 28 is inserted; and the partition wall 15 separating the bolting chambers 11*a*, 11*b* from the insertion hole 16. Further, the second interlock connector 39 is provided at a position corresponding to the insertion hole 16.

Therefore, in the connector 1, because the partition wall 15 partitions the insertion hole 16 provided with the second interlock connector 39 and the bolting chambers 11*a*, 11*b*, the first interlock connector 28 is prevented from making contact with or colliding with the terminal fittings 12*a* to 12*f* in the bolting chambers 11*a*, 11*b* and the bolts 45*a* to 45*f* for fastening the terminal fittings 12*a* to 12*f* and the electrodes 44*a* to 44*f*.

Further, because the second interlock connector 39 is provided in the insertion hole 16 into which the first interlock connector 28 is inserted, as the first interlock connector 28 is inserted into the insertion hole 16, the cover member 6 is positioned.

Therefore, the cover member 6 is prevented from being assembled to the bolting chambers 11*a*, 11*b* while the cover member 6 is displaced, and the packing 25 of the cover member 6 is prevented from being gouged by opening edges of the bolting chambers 11*a*, 11*b*.

Further, according to this embodiment, in the connector 1, because the partition wall 15 is a connection wall formed by opening a position corresponding to the insertion hole 16 and a position corresponding to the bolting chambers 11*a*, 11*b*, the terminal receiving portion 17 is connected to the connection wall. Therefore, the terminal receiving portion 17 is prevented from being deformed by shrinkage upon molding.

Incidentally, in the above embodiment and the modified embodiment, two bolting chambers 11*a*, 11*b* are provided in the terminal receiving portion 17 of the connector 1. However, when the partition wall 15 is provided between the bolting chamber and the insertion hole 16, the number of the bolting chambers may be one or more than two.

Further, the above embodiment and the modified embodiment only show a representative example of the present invention. The present invention is not limited to the embodiments. Namely, various modifications can be practiced within a scope of the present invention.

INDUSTRIAL APPLICABILITY

The connector according to the present invention can be used as a connector for attaching an electric wire supplying three-phase AC power source to an inverter mounted on an electric vehicle or a hybrid vehicle to a connector attachment portion of the inverter.

REFERENCE SIGN LIST

1 connector
2 connector attachment portion
5 connector housing
6 cover member
11*a*, 11*b* bolting chambers
12*a* to 12*f* terminal fittings
15 partition wall
16 insertion hole
16*a* second insertion hole
17 terminal receiving portion
28 first interlock connector
39 second interlock connector
44*a* to 44*f* electrodes
45*a* to 45*f* bolts

The invention claimed is:

1. A connector comprising:

a terminal receiving portion provided with a terminal fitting to be connected to an electrode of a connector attachment portion;

a cover member for covering the terminal receiving portion:

a first interlock connector projecting from the cover member; and a second interlock connector provided on the terminal receiving portion and configured to be fitted to the first interlock connector, wherein when the cover member covers the terminal receiving portion, the first and second interlock connectors are fitted to each other, and thereby the connector detects that the cover member covers the terminal receiving portion to permit conduction between the electrode of the connector attachment portion and the terminal fitting, wherein the terminal receiving portion is provided with a bolting chamber in which the terminal fitting and the electrode are fastened with a bolt, an insertion hole into which the first interlock connector is inserted, and a partition wall for separating the bolting chamber from the insertion hole, wherein the bolting chamber and the insertion hole are arranged adjacent to each other in a direction perpendicular to a central axis of the insertion hole, and the partition wall is configured to separate the bolting chamber and the insertion hole in said direction, and wherein the second interlock connector is provided at a position corresponding to the insertion hole.

2. The connector as claimed in claim 1, wherein the partition wall is a connection wall formed by respectively opening a position corresponding to the insertion hole and a position corresponding to the bolting chamber.

* * * * *